United States Patent [19]

Hebert

[11] Patent Number: 4,738,202

[45] Date of Patent: Apr. 19, 1988

[54] CARTRIDGE CASE AND CARTRIDGE ARRANGEMENT AND METHOD

[75] Inventor: John R. Hebert, Baltimore County, Md.

[73] Assignee: AAI Corp., Hunt Valley, Md.

[21] Appl. No.: 932,969

[22] Filed: Nov. 20, 1986

Related U.S. Application Data

[63] Continuation of Ser. No. 702,558, Feb. 15, 1985, abandoned, which is a continuation-in-part of Ser. No. 594,516, Mar. 29, 1984, abandoned, which is a continuation of Ser. No. 270,754, Jun. 5, 1981, abandoned, which is a continuation-in-part of Ser. No. 20,780, Mar. 15, 1979, abandoned.

[51] Int. Cl.[4] ..... F42B 5/30

[52] U.S. Cl. ..... 102/467; 29/1.31; 29/453; 102/430; 102/464

[58] Field of Search ..... 102/430, 464, 466–469, 102/501, 434; 29/1.3–1.32, 453

[56] References Cited

U.S. PATENT DOCUMENTS

| | | | |
|---|---|---|---|
| 1,233,071 | 7/1917 | Lindquist | 102/465 |
| 2,535,624 | 12/1950 | Burney | 102/430 |
| 3,955,506 | 5/1976 | Luther et al. | 102/467 |
| 4,147,107 | 4/1979 | Ringdal | 102/467 |
| 4,295,425 | 10/1981 | Davis | 102/501 X |

FOREIGN PATENT DOCUMENTS

| | | | |
|---|---|---|---|
| 80537 | 5/1951 | Czechoslovakia | 102/469 |
| 2705235 | 8/1978 | Fed. Rep. of Germany | 102/467 |
| 594878 | 1/1959 | Italy | 102/466 |
| 116110 | of 1969 | Norway | 102/430 |

*Primary Examiner*—Harold J. Tudor
*Attorney, Agent, or Firm*—Reginald F. Pippin, Jr.

[57] ABSTRACT

A cartridge case and cartridge arrangement and method in which a base is joined along an annular intermating chevron-shaped joint with a sleeve. In the illustrated and preferred embodiment the base is metal and the sleeve is glass-fiber-reinforced plastic. The case has a propellant, projectile, and a percussive primer. A plurality of circumferentially spaced vent holes are formed in the plastic sleeve along a portion of the chevron joint as an aid to reducing excessive interface friction loads at the chevron joint during firing of the cartridge. A less preferred modification and mode of practice of the invention is disclosed in which the base is formed of plastic material or a composite glass-plastic or other composite plastic material, and the sleeve is formed of metal. A further less preferred modification and mode of practice is disclosed in which both the sleeve and the base are formed of similar materials.

40 Claims, 3 Drawing Sheets

FIG. 2
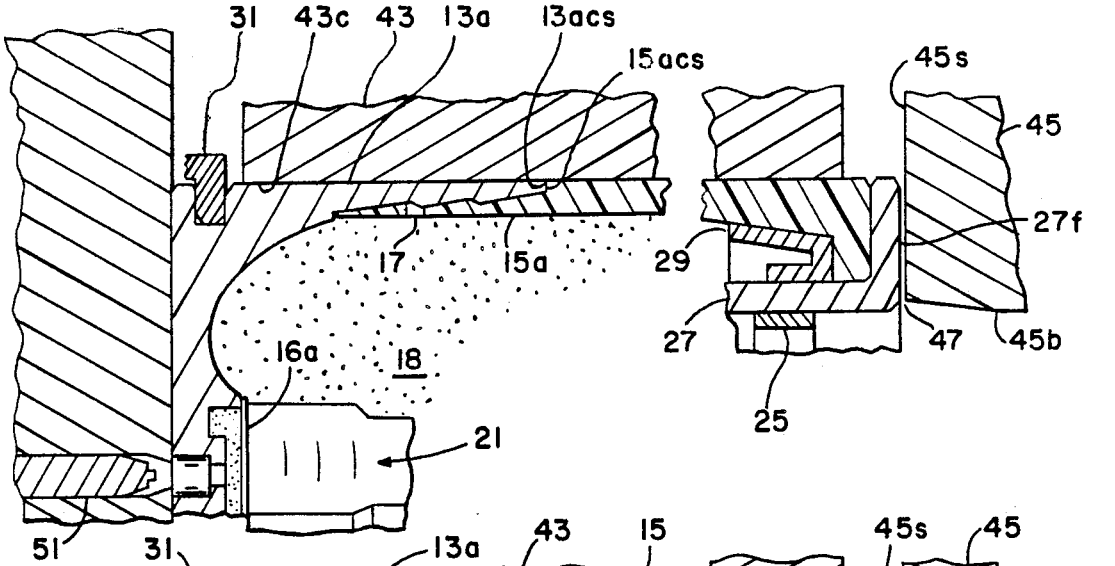
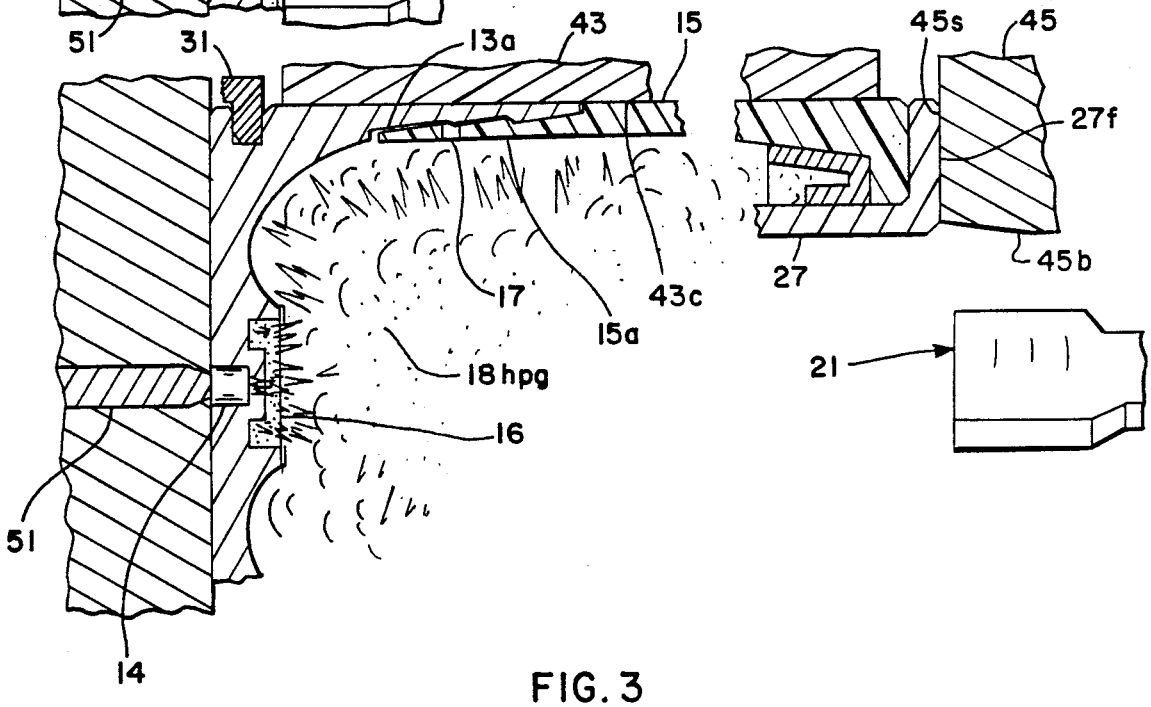
FIG. 3

CARTRIDGE CASE AND CARTRIDGE ARRANGEMENT AND METHOD

This application is a continuation of my copending application Ser. No. 702,558, filed Feb. 15, 1985, now abondoned which in turn is a continuation-in-part of application Ser. No. 594,516, filed Mar. 29, 1984, now abandoned, which in turn is a continuation of application Ser. No. 270,754, filed June 5, 1981, now abandoned, which is a continuation-in part of my copending application Ser. No. 20,780, filed Mar. 15, 1979, now abandoned.

This invention relates to a cartridge case having a base and a sleeve connected through an interference joint formed thereby, and to a cartridge arrangement incorporating such case, in which the preferred embodiment and mode of practice incorporates a metal base and a fiber-reinforced plastic sleeve.

It is desirable to provide a combined plastic and metal cartridge case and cartridge arrangement. However, an individual base and sleeve of such materials creates substantial problems in that such joints tend to fail under firing loads. It has particularly been found that in some important practical firing conditions where relatively large lengthwise expansion of the cartridge case can occur, such as where the propellant gas pressures cause the breech block and/or other portions of the cartridge chamber to yield and expand the firing chamber lengthwise and/or where the firing chamber has an initial large headspace enabling lengthwise expansion of the case during firing, an otherwise normally successful interference joint will fail in the plastic section due to excessive interface friction along the mating joint surfaces.

It is an object and feature of this invention to provide a metal-plastic cartridge case and cartridge and method incorporating such, in which a chevron interference joint is provided at the interface between the base of metal or plastic on the one hand, and the sleeve of plastic or metal on the other hand, and in which an arrangement and method for joint-friction reduction is provided by forming plural vent holes in the radially innermost of these two parts along a portion of the chevron interface so as to reduce the the interface friction in the joint during firing. Such is particularly advantageous in a metal base/plastic sleeve arrangement with the sleeve extending within a portion of the base along the chevron interface joint zone, although a reverse configuration may be utilized to less advantage in which the sleeve overlaps the metal base along this chevron joint zone. Likewise, the improved case and cartridge arrangement and method may be utilized with a reversal of materials, or with similar materials.

Still other objects and attendant advantages will become apparent from a reading of the following detailed description of a preferred physical embodiment constructed according to the invention, taken in conjunction with the accompanying drawings, in which:

FIG. 2 is a fragmentary view of the cartridge and chamber, illustrating schematically the action of the various parts during firing and resultant propellant gas pressurization.

FIG. 3 is a cross-sectional view of the cartridge case during the ignition phase of the propellant. This cross-sectional view illustrates the effect of the longitudinal forces on the chevron-type mating surfaces between the metal case base and the plastic case shell wall.

Figure 1:
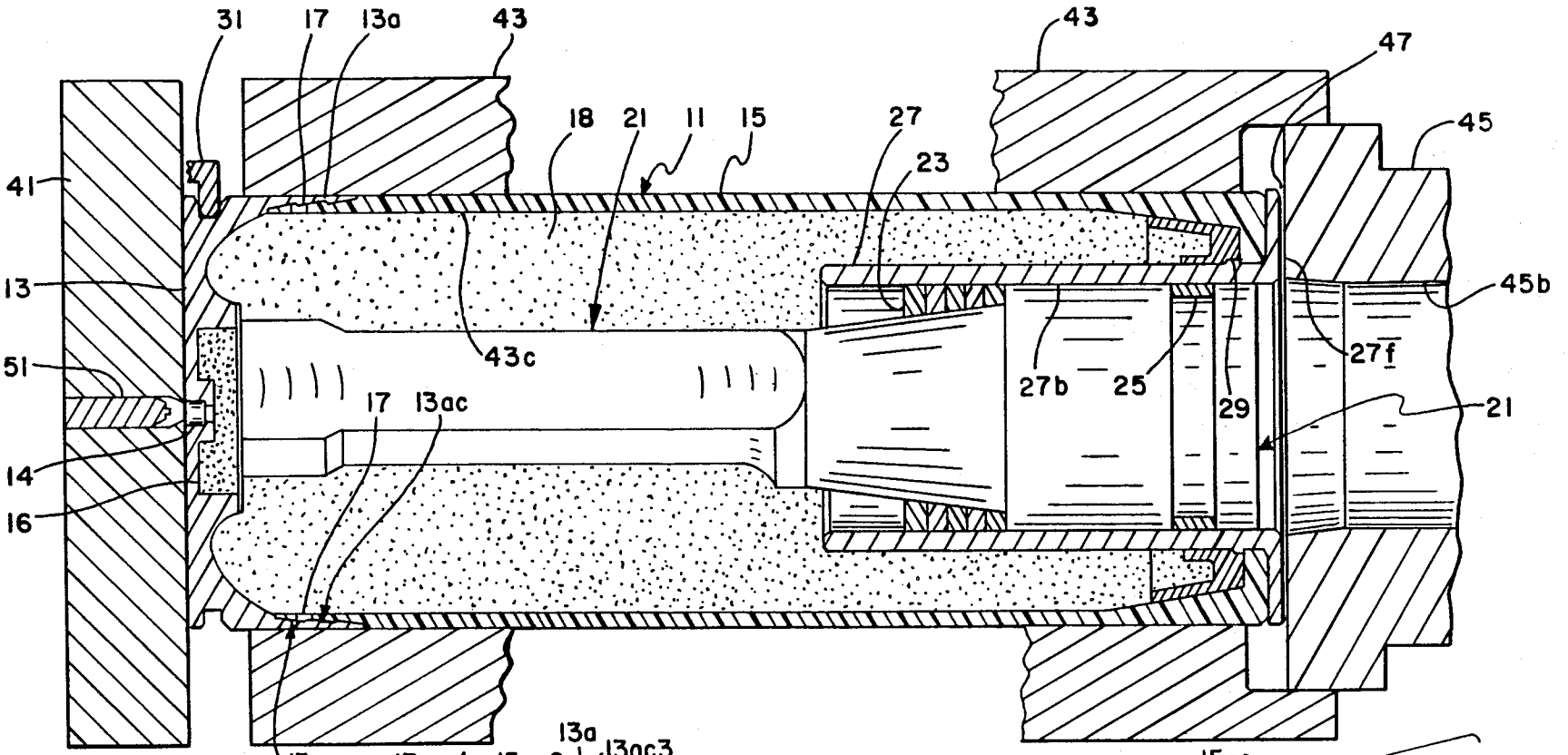
FIG. 1 is a longitudinal section view of a preferred embodiment of a cartridge case and cartridge employing a metal base and glass-fiber reinforced plastic sleeve according to the invention, showing such in a cartridge chamber preparatory to firing.

Referring now in detail to the Figures of the drawings, in the illustrative embodiment cartridge 11 has a metal-plastic cartridge case formed of a metal base 13, a suitable metal being steel, brass, nickel, etc. and a plastic sleeve, suitable plastic materials being glass-reinforced or other fiber-reinforced nylon, polycarbonate, acetal resin or the like.

A projectile 21 of suitable desired configuration is suitably secured in the cartridge, and a conventional or other desired main propellant charge 18 is ignitable by a conventional percussive or other desired primer 14 which is provided for igniting the main propellant charge, the illustrative example including an intermediate black power charge which may have a frangible cover **16*a*** thereon.

In the illustrative embodiment the nose end of the projectile 21 is carried in a steel sleeve 27 within the bore **27*b* of which it rides during exit from the case 13, 15. Sleeve 27 has a radially extending end flange 27*f* which is pressed forwardly against the rear face of the weapon barrel 45 upon firing of the cartridge 11, and an annular obturating case seal 29 is provided to seal the propellant gases during the firing action. The nose end of the illustrative projectile is provided with a bore-riding nylon sleeve 25 and a multiple ring seal 23 which wedges along the tapered projectile surface to effect a seal with the bore 27*b* initially and subsequently with the barrel bore 45*b***.

The cartridge 11 is shown a chambered in a firing chamber **43*c* formed in a firing chamber block 43, and removably secured in place by a pawl 31, with a breech block 41 through which a suitable firing pin 51 moves to percussively engage and fire the primer 14 and the propellant powder charges 16, 18**.

The cartridge 11 as seated in the firing chamber **43*c* may or may not have an initial head space gap of significant size at the front and/or rear end of the cartridge 11 between the cartridge and either or both of the barrel rear shoulder 45*s* and the breech block 41, and/or the breech block structure may itself permit a significantly large head space charge to be effected, and thereby effectively elongating the firing chamber, during firing and under the pressures of the propellant gases acting on the opposite end sections 13 and 15, 27 of the projectile. As a result the metal base 13 and plastic sleeve 15 are moved in opposite directions by the combined amount of any initial head space and the increase in head space through elongation of the firing chamber 43*c* under the pressure exerted during firing of the propellant charges 16, 18 to propel the projectile from the cartridge case and along the barrel bore 45***b*.

To this end it is desirable to provide a joint between the metal base 13 and the plastic sleeve which will not only withstand handling loads and acceleration loads during firing, but also will enable the relative longitudinal expansion movement between the metal base 13 and nylon sleeve 15 during firing without rupture or separation, while still effecting a sealed joint both prior to and during firing.

As an illustration of the overall head space which may be required to be accommodated, in one chamber of approximately 13.25 inches length a head space change of approximately 0.120 inch has been encountered.

To this end, it is important to minimize the incidence of failure at the metal/plastic sleeve joint under these practical operating conditions where such may occur, and the present invention is directed to accomplish this object and purpose.

The metal base 13 is joined to the plastic sleeve 15 through an annular chevron joint which provides both good handling and acceleration load strength while providing an effective obturating gas seal during firing. In addition the joint enables frictional relief or reduction along a substantial extent of its length during firing to thereby enable the joint to accommodate the relative frictional sliding movement between the base 13 and sleeve 15 for head space accommodation and thereby minimizing the otherwise substantial likelihood of separation failure at the joint.

The chevron joint is formed by two annular interfacing intermating complementary annular step-like chevron surfaces 13*ac* and 15*ac* formed respectively on the forwardly facing rim lip 13*a* of the metal base 13 and the rear end surface 15*a* of the plastic sleeve 15. The chevron surfaces 13*ac* and 15*ac* are also generally tapered, and the plastic chevron section 15*ac* is the radially inboard one of the two sections, thereby enabling the plastic section to be obturated and into sealing relation with the stronger less yielding metal band therearound as formed by the inwardly facing chevron section 13ac of the metal base rim. In the assembled condition prior to firing the joint is mechanically stable and forms a secure mechanical interlocking connection. In addition, as above noted, the tapered inner chevron section 15ac will be obturated radially outwardly into continuing sealing contact with the metal base chevron section 13*ac* under the forces of the propellant gas pressures during firing of the cartridge 11 and propulsion of the projectile 21.

However, due to the problem of the requirements for accommodating initial and/or increase of head space in the firing chamber upon firing of the cartridge, the chevron joint has very substantial longitudinal tensile stresses exerted thereon, which desirably are accommodated by permitting longitudinal slippage along the chevron joint intermating surfaces. With the chevron joint as simply above-described the interface friction along the entirety of the length of the chevron surfaces 13*ac* and 15*ac* is so great as to seriously approach or exceed the strength of plastic materials, including those reinforced with glass or other suitable fibers. This problem is minimized by providing a plurality of radial vent holes 17 in the zone of the chevron surface 15*ac* spaced sufficiently away from the chevron zone 15*ac*3 as to enable it to maintain an obturating seal with the corresponding chevron surface 13*ac*3 of the metal base chevron section 13*ac*, while enabling pressure-equalizing passage of the pressurized propellant gases through the vent holes 17 to thereby relieve the friction forces along the adjoining chevron surface sections 13*ac*1, 13*ac*2 and 15*ac*1, 15*ac*2. The total effect is to materially reduce the friction and mechanical surface area, and thereby reduce the resistive forces opposing a sliding expansion of the chevron joint during firing, and to thus enable a substantially greater assurance of maintaining not only an effective gas seal at the joint but also to maintain the structural integrity and reduce the likelihood of failure of the case at this zone.

Figure 5:
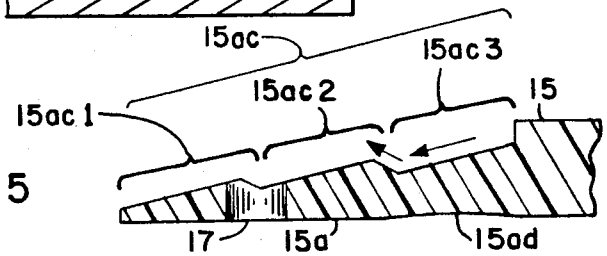
FIG. 5 is an enlarged fragmentary section view of the plastic sleeve portion of the chevron joint showing the zone of interface frictional loading and sealing during firing and the friction-relieving action effected by gases passing through the friction-reducing vent holes.
Figure 4:
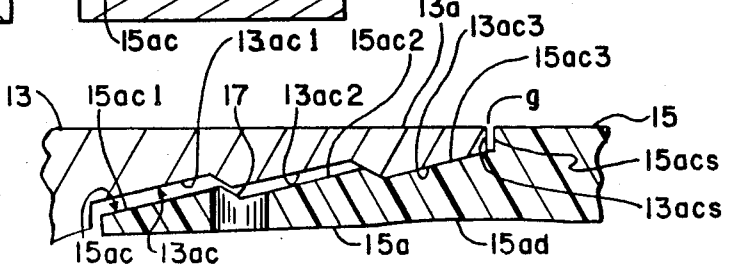
FIG. 4 is an enlarged fragmentary section view of the chevron joint, schematically illustrating the venting and friction relieving action of the vent holes along a portion of the joint during firing.

The action of the vented chevron joint 13*ac*, 15*ac* is shown schematically in enlarged form in FIG. 4, the venting separation action being exaggerated for clarity of illustration. FIG. 5 illustrates the zone of resultant obturating seating 15*ac*1 and 15*ac*2. The illustration in FIG. 4 shows schematically the radial deformation at 15*ad* of the plastic sleeve 15 which results from obturating deformation of the sleeve 15 outwardly against the metal base in the zone of sealing chevron zones 13*ac*3, 15*ac*3, 15*ac*3. Likewise, FIG. 4 schematically shows the resultant elongation movement positioning of the base 13 and sleeve 15 joint sections 13*ac*, 15*ac*, resulting in a gap into which a small radial obturating convex deformation of the sleeve 15 may occur, as shown.

It will thus be appreciated that a metal/plastic cartridge case and cartridge construction is provided which not only provides a good interface joint seal which has strength for withstanding handling and acceleration loads, but also has provision for automatically reducing the joint interlock resistive action during firing, and this minimizes and materially reduces the likelihood of joint failure during firing, where large head space expansion is involved.

Figure 6:
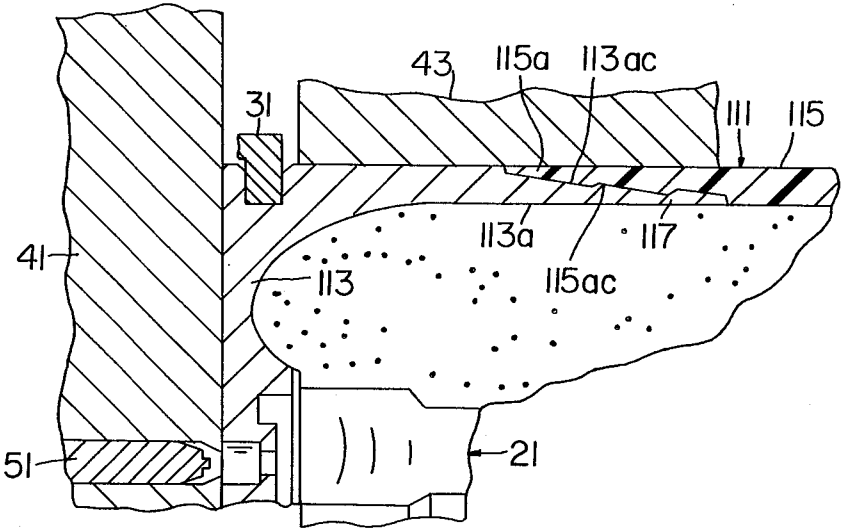
FIG. 6 is a fragmentary section view of a substantially less desirable modification according to another aspect of the invention in which the sleeve overlaps the metal base, in which the vent holes are formed.

FIG. 6 illustrates a modification of the invention which, while technically feasible, is substantially less desirable than the previously illustrated and described embodiment of FIGS. 1–5. In FIG. 6, the base 113 and sleeve 115 are joined together with the sleeve outside and the base inside at the chevron slip-vented interface joint, formed respectively by base chevron section 113*a* and sleeve chevron section 115*a*. Radially extending holes 117 are formed in base 113, which together with chevron surfaces 113*ac* and 115*ac* serve to enable automatic reduction of joint interlock resistive action during firing, in a manner similar to the reduction of joint interlock resistive action, at the vented chevron interlocking joint of the preferred embodiment of FIGS. 1–5.

While the invention has been specifically illustrated and described with reference to both an illustrative and preferred embodiment and a modification embodiment, it will be apparent that various modifications and improvements may be made without departing from the scope or spirit of the invention. Such modifications, although substantially less desirable, include reversal of the slip-vented interface joint such as in the modification of FIG. 6, reversal of the materials, and use of other materials. These mentioned alternative modifications offer substantially less advantages and, to a varying extent (varying with the individual modification) less reliability than is provided by the preferred embodiment. Accordingly, it is to be understood that the invention is not to be limited by the particular illustrative embodiment, but only by the scope of the particular illustrative embodiment, but only by the scope of the appended claims.

I claim:

1. A cartridge case comprising,
a base,
a sleeve connected to said base through a mechanical interlocking overlapping joint having radially innermost and outermost overlapping portions which have interengaging mechanical interlock surfaces, which joint forms an obturating seal under radially outward pressure exerted thereon,
and at least one radially extending vent hole formed in the radially innermost of the overlapping portions of said joint and within the zone of said mechanical interlock surfaces to enable partial pressure equalization and longitudinal pressure-responsive interlock relief relative movement along a longitudinal portion of said joint while enabling obturating circumferential sealing of the remaining portion of said joint.

2. A cartridge case according to claim 1,
said base being formed of metal and said sleeve being formed of a plastic material.

3. A cartridge case according to claim 2,
said mechanical interlocking overlapping joint comprising overlapping interfacing annular chevron surfaces formed on each of said base and said sleeve,
said vent holes being formed in the zone of and extending through the outwardly facing innermost one of said chevron surfaces.

4. A cartridge case according to claim 1,
further comprising a plurality of said radially extending vent holes circumferentially spaced about and formed in said radially innermost of said overlapping portions of said joint.

5. A cartridge case according to claim 4,
said base being formed of metal and said sleeve being formed of a plastic material.

6. A cartridge case according to claim 4,
said sleeve being formed of a fiber-reinforced cured plastic resin.

7. A cartridge case according to claim 4,
said mechanical interlocking overlapping joint comprising overlapping interfacing annular chevron surfaces formed on each of said base and said sleeve,
said vent holes being formed in the zone of and extending through the outwardly facing innermost one of said chevron surfaces.

8. A cartridge case according to claim 7,
said base being formed of metal and said sleeve being formed of a plastic material.

9. A cartridge case according to claim 7
said sleeve being formed of a fiber-reinforced cured plastic resin.

10. A cartridge case according to claim 7
said base having a longitudinally extending annular lip a portion of which has formed thereon one of said interfacing annular chevron surfaces forming said joint.

11. A cartridge case according to claim 10
said base lip being tapered at its end zone, and said one chevron surface being formed along said tapered end zone,
said interfacing sleeve chevron surface being substantially complementarily tapered and chevron surfaces in the zone of said overlapping joint.

12. A cartridge case according to claim 11,
said sleeve being disposed radially inboard of said base in the zone of said joint and having its said chevron surface facing radially outwardly and having said vent holes formed therein.

13. A cartridge comprising a cartridge case according to claim 1, and further comprising
a projectile carried by said case,
a propellant powder charge disposed within said case,
and means for igniting said propellant powder charge.

14. A cartridge comprising a cartridge case according to claim 4, and further comprising
a projectile carried by said case,
a propellant powder charge disposed within said case,
and means for igniting said propellant powder charge.

15. A cartridge case comprising
a base,
a sleeve connected to said base through a mechanical interlocking overlapping joint having radially innermost and outermost overlapping portions which have interengaging mechanical interlock surfaces, which joint forms an obturating seal under radially outward pressure exerted thereon,
and a plurality of circumferentially spaced radially extending vent holes formed in the radially innermost of the overlapping portions of said joint to enable partial pressure equalization and longitudinal pressure-responsive interlock relief relative movement along a longitudinal portion of said joint while enabling obturating circumferential sealing of the remaining portion of said joint,
said mechanical interlocking overlapping joint comprising overlapping interfacing chevron surfaces formed on each of said base and said sleeve,
said sleeve being disposed radially inboard of said base in the zone of said joint and having its said chevron surface facing radially outwardly and having said vent holes formed therein,
said vent holes being formed in the zone of and extending through the outwardly facing innermost one of said chevron surfaces.

16. A cartridge case according to claim 15
said base being formed of metal and said sleeve being formed of a plastic material.

17. A cartridge case according to claim 16
said sleeve being formed of a fiber-reinforced cured plastic resin.

18. A cartridge case comprising
a base,
a sleeve connected to said base through a mechanical interlocking overlapping joint having radially innermost and outermost overlapping portions, which have interengaging mechanical interlock surfaces, which joint forms an obturating seal under radially outward pressure exerted thereon,
and a plurality of circumferentially spaced radially extending vent holes formed in the radially innermost of the overlapping portions of said joint and within the zone of said mechanical interlock surfaces to enable partial pressure equalization over a longitudinal portion only of said joint while enabling obturating circumferential sealing of the remaining portion of said joint,
said mechanical interlocking overlapping joint comprising overlapping interfacing annular chevron surfaces formed on each of said base and said sleeve, said sleeve being disposed radially inboard of said base in the zone of said joint and having its said chevron surface facing radially outwardly and having said vent holes formed therein.

19. A cartridge case according to claim 18,
said base being formed of metal and said sleeve being formed of a plastic material.

20. A cartridge case according to claim 18,
said sleeve being formed of a fiber-reinforced cured plastic resin.

21. A cartridge case according to claim 18,
said base having a longitudinally extending annular lip a portion of which has formed thereon one of said interfacing annular chevron surfaces forming said joint.

22. A cartridge case according to claim 21,
said base lip being tapered at its end zone, and said one chevron surface being formed along said tapered end zone,
said interfacing sleeve chevron surface being substantially complementarily tapered with interfitting chevron surfaces in the zone of said overlapping joint.

23. A cartridge comprising a cartridge case according to claim 15, and further comprising
a projectile carried by said case,
a propellant powder charge disposed within said case,
and means for igniting said propellant powder charge.

24. A cartridge case according to claim 18,
said base having a longitudinally extending annular rim or lip a portion of which has formed thereon one of said interfacing annular chevron surfaces forming said joint,
said base rim or lip being tapered at its end zone, and said one chevron surface being formed along said tapered end zone,
said interfacing sleeve chevron surface being substantially complementarily tapered with interfitting chevron surfaces in the zone of aid overlapping joint,
each of said chevron surfaces being formed of discrete step surfaces alternately oppositely canted at acute angles relative to an imaginary longitudinal center line of said case.

25. A cartridge case according to claim 18,
each of said chevron surfaces being formed of discrete step surfaces alternately oppositely canted at acute angles relative to an imaginary longitudinal center line of said case.

26. A cartridge case according to claim 15,
each of said chevron surfaces being formed of discrete step surfaces alternately oppositely canted at acute angles relative to an imaginary longitudinal center line of said case.

27. A cartridge case according to claim 26,
said base being formed of metal and said sleeve being formed of a plastic material.

28. A cartridge case according to claim 26,
said sleeve being formed of a fiber-reinforced cured plastic resin.

29. A cartridge case according to claim 26,
said base having a longitudinally extending annular lip a portion of which has formed thereon one of said interfacing annular chevron surfaces forming said joint.

30. A cartridge comprising a cartridge case according to claim 26, and further comprising
a projectile carried by said case,
a propellant powder charge disposed within said case,
and means for igniting said propellant powder charge.

31. A cartridge case comprising
a base,
a sleeve connected to said base through a mechanical interlocking overlapping joint having gradually innermost and outermost overlapping portions which have interengaging mechanical interlock surfaces, which joint forms an obturating seal under radially outward pressure exerted thereon,
and a plurality of circumferentially spaced radially extending vent holes formed in the radially innermost of the overlapping portions of said joint and within the zone of said mechanical interlock surfaces to enable partial pressure equalization and longitudinal pressure-responsive interlock relief over a longitudinal portion of said joint while enabling obturating circumferential sealing of the remaining portion of said joint,
said mechanical interlocking overlapping joint comprising overlapping interfacing annular chevron surfaces formed on each of said base and said sleeve.
and said vent holes being formed in the zone of and extending through the outwardly facing innermost one of said chevron surfaces.

32. A cartridge case according to claim 31,
said base being formed of metal and said sleeve being formed of a plastic material.

33. A cartridge case according to claim 31,
said sleeve being formed of a fiber-reinforced cured plastic resin.

34. A cartridge case according to claim 31,
said base having a longitudinally extending annular lip a portion of which has formed thereon one of said interfacing annular chevron surfaces forming said joint.

35. A cartridge case according to claim 34,
said base lip being tapered at its end zone, and said one chevron surface being formed along said tapered end zone,
said interfacing sleeve chevron surface being substantially complementarily tapered with interfitting chevron surfaces in the zone of said overlapping joint.

36. A cartridge case according to claim 31,
said base having a longitudinally extending annular lip a portion of which has formed thereon one of said interfacing annular chevron surfaces forming said joint,
said base rim or lip being tapered at its end zone, and said one chevron surface being formed along said tapered end zone,
said interfacing sleeve chevron surface being substantially complementarily tapered with interfitting chevron surfaces in the zone of said overlapping joint,
each of said chevron surfaces being formed of discrete step surfaces alternately oppositely canted at acute angles relative to an imaginary longitudinal center line of said case.

37. A cartridge according to claim 31, each of said chevron surfaces being formed of discrete step surfaces alternately oppositely canted at acute angles relative to an imaginary longitudinal center line of said case.

38. The method of manufacture of a cartridge case having a metal base and a plastic sleeve in which excessive interface friction loads are reduced at a plastic/-metal interface circumferential joint formed between a chevron-surface-interconnected metal cartridge base and an annular plastic cartridge sleeve having radially innermost and outermost overlapping mutually interfacing and interfitting longitudinally tapered chevron-surfaced annular lips, comprising forming at least one radially extending vent hole in said radially innermost one of said chevron-surfaced annular lips and extending through the chevron surface thereof to thereby enable a gas-pressured partial separation and longitudinal friction reduction between the interfitting chevron surfaces of said annular lips to be effected as a function of pressurizing of the radial interior formed said said chevron-surface-interconnected metal cartridge base and plastic sleeve, to thereby reduce likelihood of cartridge breakage upon propellant ignition and propellant gas pressure build-up, and joining said base and sleeve together in pressure sealing longitudinally pressure-responsively relievable mechanically interlocked relation.

39. The method according to claim 38, forming a plurality of radially extending vent holes spaced circumferentially about said innermost one of said chevron-surfaced annular lips.

40. The method according to claim 39, further comprising forming said innermost chevron-surfaced annular lip of plastic, and forming said plurality of vent holes in said plastic chevron-surfaced annular lips and in registry with the chevron surface thereof.

* * * * *